US005320279A

United States Patent [19]

Giblin et al.

[11] Patent Number: 5,320,279

[45] Date of Patent: Jun. 14, 1994

[54] CARTON FOR CONCENTRATED DETERGENT

[75] Inventors: Edward J. Giblin, Finksburg, Md.; Jeannine D. Griffiths, Tannersville, Pa.; Preston M. Smith, Westminster, Md.

[73] Assignee: Lever Brothers Company, Division of Conopco, Inc., New York, N.Y.

[21] Appl. No.: 18,346

[22] Filed: Feb. 16, 1993

Related U.S. Application Data

[63] Continuation of Ser. No. 459,015, Dec. 29, 1989, abandoned.

[51] Int. Cl.[5] ..... B65D 5/46; B65D 5/54; B65D 5/56

[52] U.S. Cl. ..... 229/225; 220/416; 229/117.22; 229/117.26; 229/917; 229/930

[58] Field of Search ..... 229/117.19, 117.22, 229/117.23, 117.24, 117.25, 117.26, 912, 915, 917, DIG. 4, DIG. 6, DIG. 11, 146, 225; 220/94 R, 415, 416; 383/14; 206/611, 624

[56] References Cited

U.S. PATENT DOCUMENTS

| | | | |
|---|---|---|---|
| 2,320,289 | 5/1943 | Marx . | |
| 2,348,377 | 5/1944 | Goodyear | 206/611 |
| 2,367,476 | 1/1945 | Tyrseck | 206/624 |
| 2,396,150 | 3/1946 | Bonville . | |
| 2,473,055 | 6/1949 | Guyer . | |
| 2,527,701 | 10/1950 | Buttery . | |
| 2,625,315 | 1/1953 | Fehrenkamp . | |
| 2,672,273 | 3/1954 | Smith | 220/416 |
| 2,706,076 | 4/1955 | Guyer . | |
| 2,758,780 | 8/1956 | Imbs | 220/416 |
| 2,822,118 | 2/1958 | Will | 206/624 |
| 2,836,342 | 5/1958 | Ringler . | |
| 2,836,343 | 5/1958 | Will | 206/624 |
| 2,874,524 | 2/1959 | Ringler . | |
| 2,922,564 | 1/1960 | Rosen . | |
| 2,922,565 | 1/1960 | Roderick et al. . | |
| 2,950,043 | 8/1960 | Ringler . | |
| 2,967,656 | 1/1961 | Vergobbi | 229/117.22 |
| 2,988,262 | 6/1961 | Guyer et al. . | |
| 2,998,910 | 9/1961 | Gillam . | |
| 3,117,709 | 1/1964 | Fuchs . | |
| 3,189,251 | 6/1965 | McFarland . | |
| 3,207,416 | 9/1965 | Koltz et al. . | |
| 3,337,114 | 8/1967 | Cockwood | 229/3.1 |
| 3,347,446 | 10/1967 | Guyer et al. | 220/416 |
| 3,438,563 | 4/1969 | Collura et al. . | |
| 3,708,108 | 1/1973 | Rosenberg, Jr. | 229/146 |
| 4,266,713 | 5/1981 | Maroszek | 229/146 |
| 4,986,420 | 1/1991 | Gunn et al. . | |
| 5,058,748 | 10/1991 | Giblin et al. . | |

FOREIGN PATENT DOCUMENTS

| | | | |
|---|---|---|---|
| 682681 | 3/1964 | Canada | 229/117.23 |
| 114771 | 8/1984 | European Pat. Off. | 229/117.22 |
| 2801729 | 7/1979 | Fed. Rep. of Germany | 229/117.23 |
| 3140390 | 4/1983 | Fed. Rep. of Germany | 229/117.24 |
| 2483885 | 12/1981 | France | 229/117.23 |
| 2484958 | 12/1981 | France | 229/117.23 |

OTHER PUBLICATIONS

Photocopy of prior carton L-74.

*Primary Examiner*—Gary E. Elkins
*Attorney, Agent, or Firm*—Gerard J. McGowan, Jr.

[57] ABSTRACT

An improved carton for superconcentrated detergent products. The carton includes front, rear and side panels and a cover. In one embodiment, the carton includes a liner which may be separate from the carton or integrated with the carton. The carton walls of the liner may include barrier materials. A hinge formed from perforated lines and score lines may be provided for the cover on the rear panel.

36 Claims, 8 Drawing Sheets

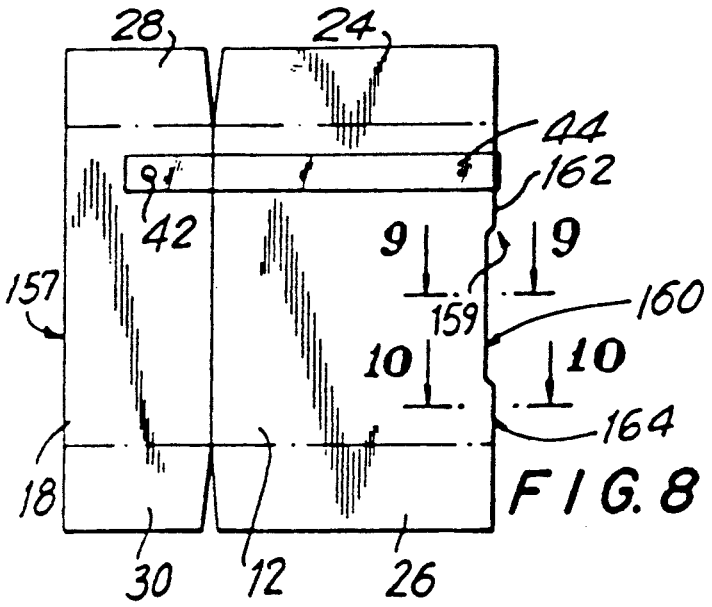
FIG. 8
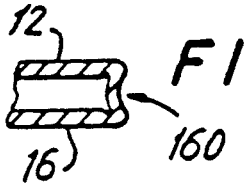
FIG. 9
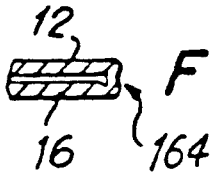
FIG. 10
FIG. 14
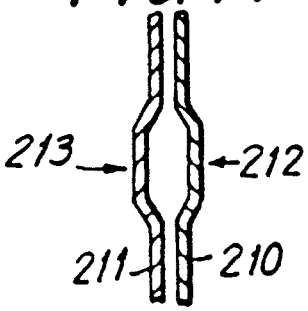
FIG. 15
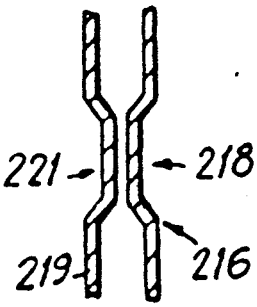

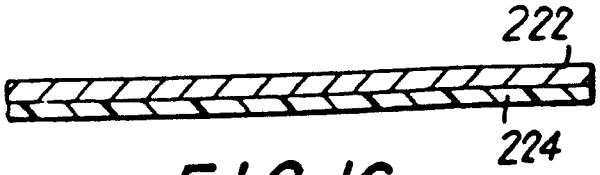
FIG. 16
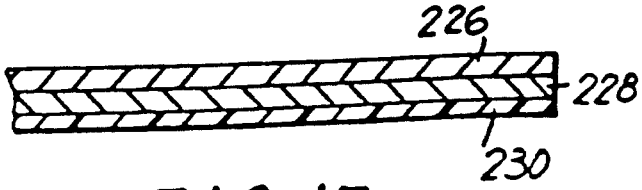
FIG. 17
FIG. 18
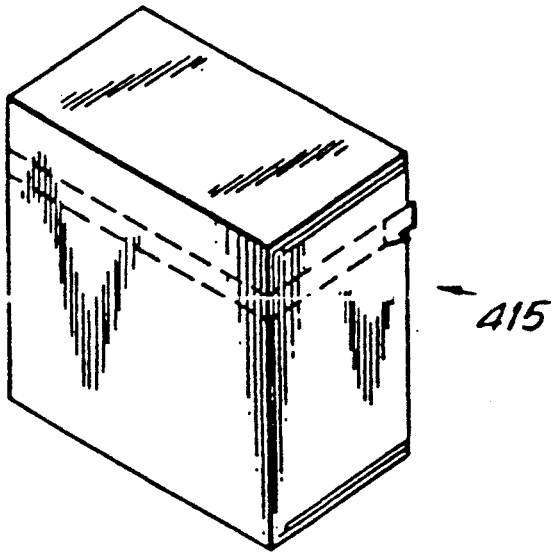

CARTON FOR CONCENTRATED DETERGENT

This is a continuation application of Ser. No. 07/459,015, filed Dec. 29, 1989, now abandoned.

BACKGROUND OF THE INVENTION

Powdered laundry detergents have often been made by simply spray drying an aqueous slurry of the ingredients and adding to the spray dried powder any required additional ingredients such as heat sensitive bleaches, bleach precursors, enzymes, etc. The densities of powders resulting from such processes have generally been low. Recently, it has been thought desirable to be able to offer to the consumer a product of higher density, i.e., a more concentrated product. Such a product would be expected to have among its advantages the fact that less detergent powder would be used to effect a comparable amount of cleaning and that less storage space would be required as a result of its concentrated nature.

Changes in the density of detergent powders also require changes in the packaging of such powders. For instance, the increase in density makes desirable the use of smaller packages to take advantage of the increased concentration of the product. Moreover, smaller packages and the inclusion of handles are desirable due to the increased weight of the product.

A previous package for containing detergent powders of higher concentrations has been sold in one or more foreign countries. The package includes four principal panels, which constitute the four walls of the carton. The walls are shorter than those of the typical detergent carton. Attached to the principal panels are the glue flap and various major and minor flaps for closing the top and bottom ends of the carton. Attached to the two side panels of the carton is a handle. The handle is attached by means of a rivet extending through the handle and the side panel near each end of the handle. The rivet is received within a slot at each end of the handle. The slots permit the handle to extend across the front of the carton blank during shipping, across the front of the erected carton during storage and display, and across the top of the carton as a handle during use by the consumer.

An additional desirable feature for such cartons is a tear tape opening. While previous cartons having tear tape openings are known, they generally are characterized by certain disadvantages. One known carton includes a tear tape functionally extending through three panels of the carton, a first side panel, the front panel, and a second side panel, leaving the rear panel substantially intact and free to function as a hinge. The tear tape is situated approximately 1/5 of the way down from the top of the panels and the aspects above the tear line function as a cover.

A disadvantage of the prior tear tape carton is the lack of support for the cover once the tear tape has been removed. Also, components which tend to escape upon exposure to the air, such as perfumes, may be lost, and components which are sensitive to moisture may be damaged since the barrier properties of such cartons are less than optimal.

A further previous carton has included a tear tape spaced from the top and extending completely through all four sides of the carton, so that the cover created by the tape can be completely removed. This prior carton includes a four-sided liner, each wall of which corresponds closely in dimension to the four panels of the carton. The liner serves to retain the cover on the carton after the tear tape has been pulled. However, the removable cover may be misplaced. Moreover, use of a removable cover tends to maximize the exposure of the product to the air and moisture and increases the potential for loss of volatile components.

SUMMARY OF THE INVENTION

The present invention is directed to an improved carton particularly for concentrated (500 to 700 grams/liter) or superconcentrated (700 to 1000 grams/liter) detergent products and to a carton containing detergent products, particularly concentrated or superconcentrated detergent powders. In one embodiment, the carton includes a liner which provides support for the cover. The liner is preferably 3-sided or, more preferably, 4-sided. The liner may be a separate, e.g., a three or four panel, structure or it may be integral with the carton panels. In the latter case, the carton blank may include 5th, 6th, 7th or 8th panels in additional to the usual four. The 5th through 8th panels are folded inwardly and adhesively sealed to one or more of the original four panels to form the liner.

In another embodiment, the carton is made of an inside film laminated paperboard to provide a barrier against oxygen and moisture. There may also be a thin paper sheet laminated to the film side for enhanced adhesive sealing. Where the carton material is film-laminated paperboard to provide a barrier, it is preferred that the liner, if present, not be laminated. In still another embodiment, the liner is laminated to a film barrier layer and the carton material is not laminated. Barrier characteristics may be provided to the carton walls and/or liners in accordance with the invention by using a barrier board such as "MVTR Board" instead of by means of lamination. Other advantageous features of the cartons according to the invention include perforated lines and score lines forming a hinge for the cover on the rear panel, extended dust flaps improving the barrier characteristics of the carton, handles having dumbbell- and alternately shaped apertures, optionally with detents, and rivets located below a tear tape opening.

For a more complete understanding of the above and other features and advantages of the invention, reference should be made to the following detailed description of preferred embodiments and to the accompanying drawings.

BRIEF DESCRIPTION OF THE DRAWINGS

FIG. 8 is a plan view of a flat tubular carton having thickened score lines for balancing.

FIG. 9 is a cross section along the lines 9—9 of FIG. 8.

FIG. 10 is a cross section along the lines 10—10 of FIG. 8.

FIG. 14 is a cross section through a carton blank and liner having embossments.

FIG. 15 is a cross section through a carton blank and liner having opposing debossments.

FIG. 16 is a cross section of a carton blank which is inside-film laminated.

FIG. 17 is a cross section of a carton blank associated with a liner which is inside-film laminated.

FIG. 18 is a perspective view of a carton for concentrated detergents according to the invention which does not have a handle.

DETAILED DESCRIPTION OF THE INVENTION

Figure 1:
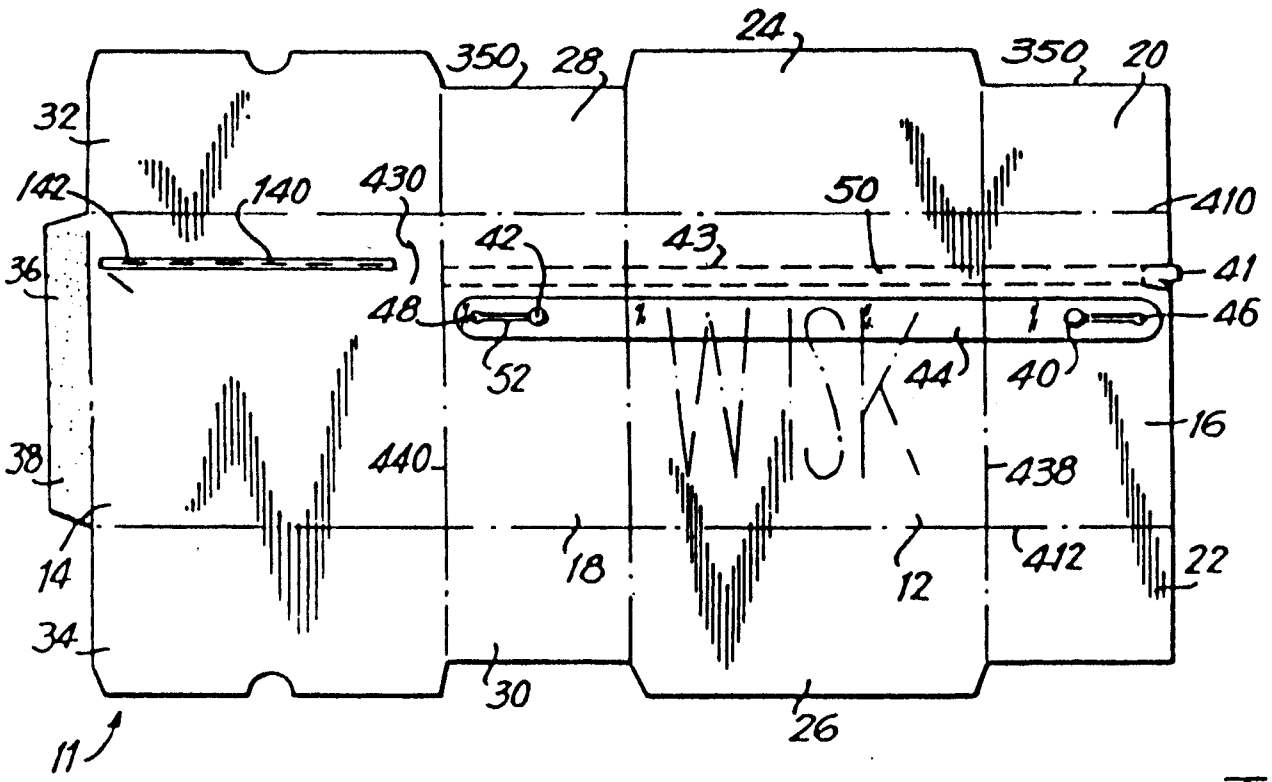
FIG. 1 is a top plan view of the carton blank used for preparing the carton of the invention.

Referring to FIG. 1, the carton blank 11 comprises front panel 12, first and second side panels 16 and 18, respectively, and rear panel 14. Upper and lower minor flaps 20 and 22, respectively extend from side panel 16. Extending from the top and bottom of front panel 12 are upper and lower outside major flaps 24 and 26, respectively. Similarly, upper and lower minor flaps 28 and 30 extend from the top and bottom of side panel 18, whereas upper and lower inside major flaps 32 and 34 extend respectively from the top and bottom of rear panel 14. The minor panels are separated from the upper and lower flaps by score lines 410 and 412, respectively.

Preferably, the minor flaps adjacent the upper aspects of the side panels are dimensioned such that when they are folded inward during erection of the carton, their medial edges 350 are fairly close to each other. They may meet or almost meet (See FIG. 7) or they may be somewhat separated (See e.g. FIG. 6). Edges 350 may, for instance, be approximately one inch apart. Preferably, the combined area of the upper minor flaps is at least 75%, especially, 85%, and particularly 90 to 95% of the area of the larger of the inside or outside major flap. This provides an added barrier against entry of moisture and other undesirable elements and against loss of product components such as perfumes, particularly when a strip of adhesive is applied parallel to and near medial edge 350. This will also prevent powder from collecting under the minor flaps and then flying out when the cover is opened.

Figure 6:
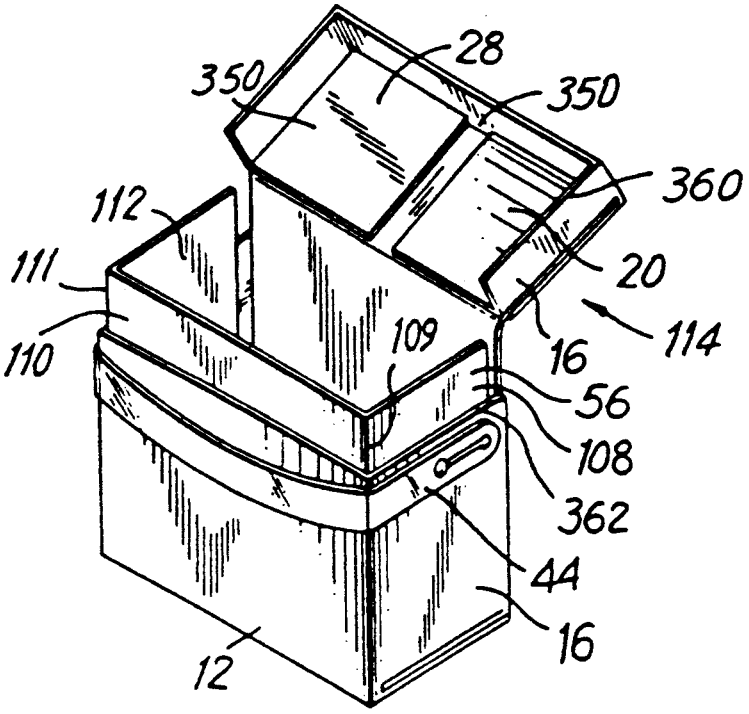
FIG. 6 is a perspective view of the carton of FIG. 3 after opening.

In the case of the carton of FIGS. 1 and 6, the edges of the minor flaps do not meet and the combined area of the minor flaps is approximately 80% of the outside major flap. For the carton of FIGS. 7, combined lengths of minor flaps 20 and 28 in the direction perpendicular to the length of the carton blank is equal or approximately equal to the length of major flap 24. In the same way, the lower minor flaps may also be dimensioned so that their edges meet or almost meet when folded inwardly.

Glue flap 36 extends off of rear panel 14. Adhesive means are applied to the glue flap at 38 during erection. When the carton is in the flattened tubular form shown in FIG. 2, adhesive means 38 adheres the front surface of glue flap 36 to the side panel.

Figure 20:
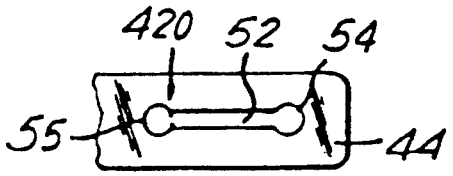
FIG. 20 is a plan view with portions cut away of a preferred handle.

Attached to side panels 16 and 18 by rivets 40 and 42 is a handle 44. The handle, which takes the form of a strap, is narrow in width and long in length. The handle is preferably flexible and clear, like handle 44, so that any printing on front panel 12 can be seen through the handle. Preferably, the handle slightly magnifies any printing on the front panel. Handle 44 includes dumbbell-shaped apertures 46 and 48, respectively at its ends, which accommodate rivets 40 and 42. Each dumbbell-shaped aperture includes a straight portion 52 connecting two semicircular end portions, a distal portion 54 and a proximal portion 55 (See FIGS. 4 and 20). Proximal portion 55 preferably has top and bottom detents 420 facing inwardly, which help retain the handle around the shank when the handle is in the shipping position.

Figure 2:
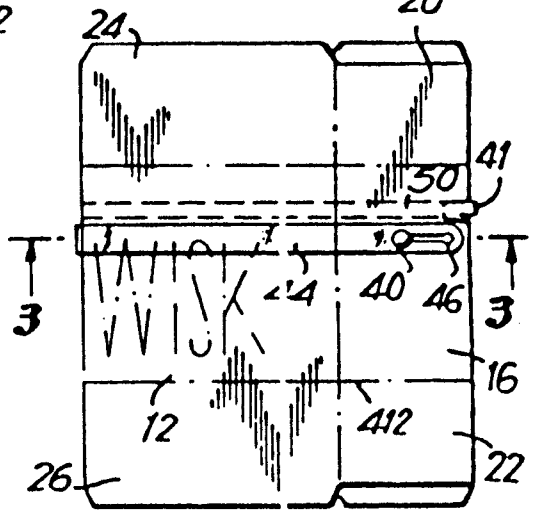
FIG. 2 is a top plan view of a flat tubular carton of the invention.

As best seen in FIGS. 1 and 2, a tear tape 50 is provided for opening of the carton. The tear tape comprises two generally parallel lines of perforations 43 in the paperboard and finger tab 41 for grasping by the consumer. Preferably, the finger tab extends beyond the edge of the carton for easier access. Instead of perforations, other separation means such as cut scores may be employed. The cut scores extend partially through the paperboard. The tear tape extends from first side panel 16 through front panel 12, second side panel 18 and terminates functionally on rear panel 14 by virtue of cut 430. The operation of the tear tape will be described in greater detail below. Advantageously, rivets 40 and 42 are located below the level of tear tape 50 so that the handle need not move when the cover is opened and closed.

Figure 3:
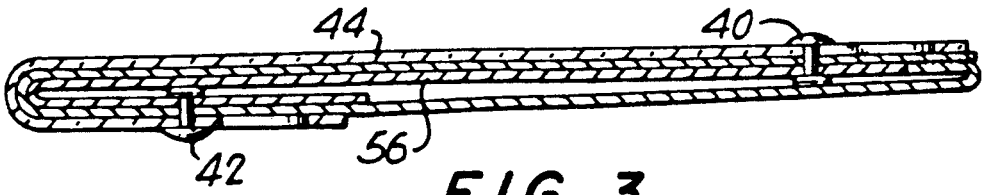
FIG. 3 is a cross section along the lines 3—3 of FIG. 2.

As can be seen in FIG. 3, rivets 40 and 42 extend through handle 44, the side panel to which it is attached, and through optional inside liner 56. As discussed below, the inside liner, if present, may be of varying configurations. Three sided liners such as liner 56, and particularly four-sided liners, are preferred.

The carton of the invention is fabricated by preparing the carton blank shown in FIG. 1 and erecting the carton. The first step in the erection of the carton is adhering the front surface of glue flap 36 to the rear surface of side panel 16 to obtain a flat, tubular partially erected structure such as that shown in FIGS. 2 and 3. While the carton of FIG. 2 is folded along the score between panels 12 and 18 and at the junction between panels 14 and 16, it may well be desirable to fold it along scores 438 and 440. After the flat tube is formed, the carton is squared, and the minor flaps and subsequently the inside and outside major flaps respectively, are folded inwardly and adhered to each other.

Figure 4:
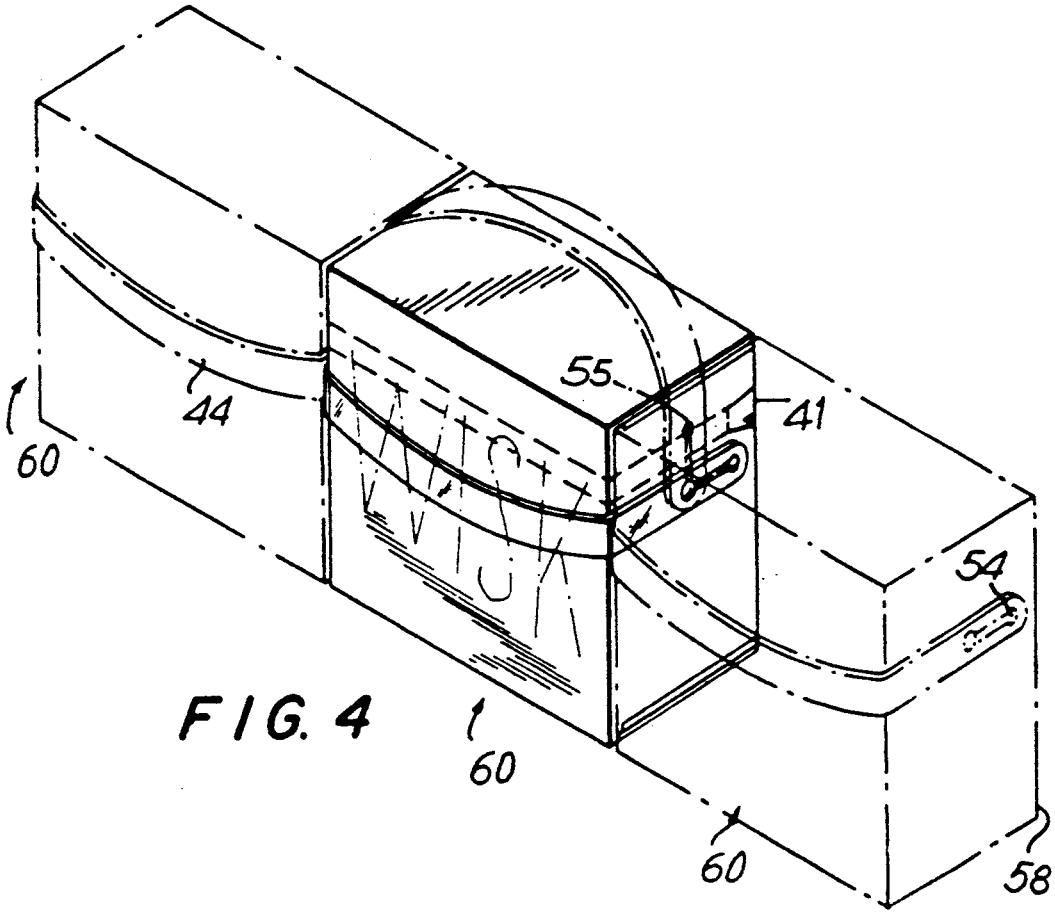
FIG. 4 is a top perspective view of three cartons according to the invention.

As can be seen from FIGS. 1, 2 and 4, handle 44 is fastened to extend across the front of front panel 12. It is desirable for ease of manufacture that the handle can be affixed to the carton prior to erection. It can be seen particularly from FIG. 1, that were it attempted to fasten the handle across rear panel 14 instead of front panel 12, it would not be possible to do so until the carton is at least partially erected by gluing glue flap 36 to side panel 16. Another alternative would be to let panel 12 constitute the rear rather than the front panel of the carton. However, since the right rear corner 58 of the erected carton at which the glue flap is bound to the side panel tends to be less attractive than the other corners of the package, it could detract from the appearance of the package to change the location of the corner to a front corner to permit the handle to be fastened across the rear of the container.

When the handle 44 is clear, it is possible to fasten the handle across the front panel of the carton without preventing the consumer from observing the printing on the front panel. The erected cartons 60 may be displayed side-by-side, as illustrated in FIG. 4. Handle 44 extends across the face of front panel 12 without obscuring information on the panel which may attract the consumer to the product or which may be important to the consumer in deciding whether to purchase the product. There is no need to perform the extra step of moving the handle from its original position across the face of the front panel to the top or the rear of the carton; moreover, the additional machinery and/or personnel which would be required to change the position of the handle after erection of the carton are unnecessary if the clear handle is used. Since the handle extends across the front of the carton it does not interfere with vertical stacking of the cartons, if desired.

When the consumer takes the package off the shelf, he/she may pull the handle forward and upward to change its position so that it extends across the top of the carton. When a handle extending across the front of the carton as shown in FIG. 4 is pulled forward, the rivets on either side of the carton leave proximal semicircular portions 55 of apertures 46, 48 and initially enter straight and narrow portions 52. Then, they enter the distal semicircular portions 54 at the other end of the aperture so that the handle is free to pivot therewithin. When the rivets are in the distal semicircular portions, the effective length of the handle is increased. This permits the handle to be extended over the top of the carton. Moreover, when extended over the top of the carton the handle with enhanced effective length has sufficient slack for convenient carrying. Thus, while the distal aspects of the semicircular apertures permit the handle to be slack for carrying, the proximal semicircular aspects of the apertures permit the handle to be stretched reasonably taut for handling during carton manufacture and shipping as seen respectively in FIGS. 1 and 4. As indicated above, detents 420 may be used, particularly in proximal aspects 55, to keep the handle in position.

Figure 5:
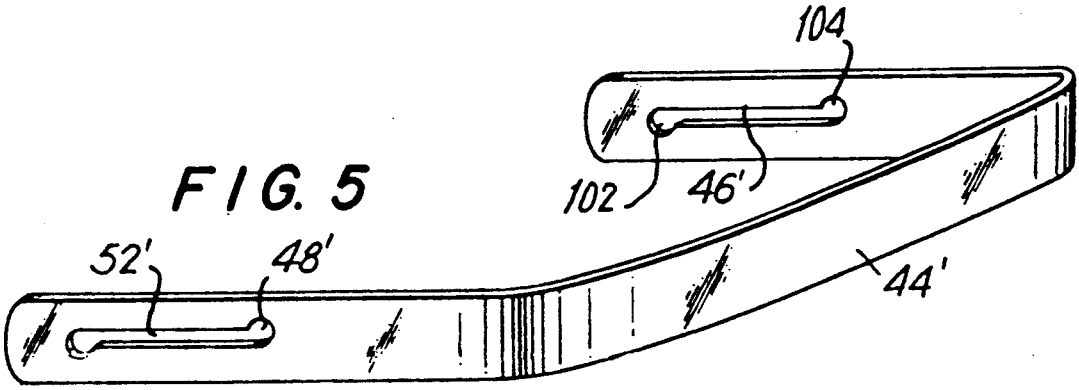
FIG. 5 is a perspective view of an alternative handle according to the invention.

In an alternate embodiment seen in FIG. 5, the handle 44' includes alternately shaped apertures 46' and 48' each of which includes a straight, narrow portion 52' and rounded, roughly semicircular aspects at each end. Consistent with the alternate shape of the aperture, one of the semicircular ends, 102, faces downward whereas the second semicircular end, 104, faces upward. Operation of the carton having the handle with alternately-shaped apertures is the same as that for the carton having a handle with dumbbell-shaped apertures. The tangential placement of the semicircular ends within the apertures follows the natural pulling motion required to extend the handle from shipping to carrying position.

Where the length of the erected carton (i.e., the length of the front panel) is B, the width of the carton is A, and the diameter of the rivet shank is C, the following are preferred approximate dimensions for the handle and rivets:

length of handle: 2A+B distance between center points of the two distal semicircular ends:

minimum: 1.33A+B; maximum: 2A+B - 0.75 distance between center points of the two proximal semicircular ends: A+B+1/8 width of straight and narrow handle portion: 0.9C distance from top of erected carton to midpoint of rivet: 0.4A distance from end of side panel to center of rivet: 0.5A The carton of the invention may be made of any of the materials typically used for carton manufacture, such as paperboard or plastic. In accordance with another aspect of the invention, if it is desired, the carton blank may be made of, or adhered to, a barrier material. Barrier materials are useful particularly to inhibit the entry of moisture and oxygen into the carton and to minimize the escape of perfume and any other volatile ingredients out of the carton. The carton blank may comprise outside- or inside-film laminated paperboard. The paperboard may be laminated with, e.g., a film of two-sided acrylic coated oriented polypropylene, e.g. "420HS" available from the Mobil Oil Corporation, or polyethylene. Or, the carton blank may comprise a barrier board such as "MVTR Board," or "Super MVTR Board," available from Jefferson Smurfit/Container Corporation of America. "MVTR Board" includes a mill-applied chemical barrier treatment as well as barriers applied in the printing operation. "Super MVTR Board" is a clay coated, chemically-treated paperboard having a high gloss top coating, catalytic or lacquer. A barrier may also be created by polyethylene or other extrusion coating or via printed coatings. In FIG. 16, carton blank 222 is laminated to a barrier film 224 of polypropylene. By barrier is meant a water vapor transmission rate of greater than 0.5 grams of water per 100 square inches per 24 hours at 80° F./80% R.H., typically from 0.5 to 0.9, especially 0.7 for inside film laminated paperboard. "Super MVTR Board" has a typical MVTR of 0.8 with a useful range of 0.7 to 1.2.

The rivets of the carton of the invention are made of metal or plastic, preferably metal. The flexible clear or opaque handle is made, preferably by extrusion, of ethylene vinyl acetate (typically 93% low density polyethylene and 7% vinyl acetate), styrene-ethylene/butylene styrene (e.g., Shell's Kraton, a high clarity thermoplastic elastomer), polyvinyl chloride or other plastic or other materials suitable for providing the durability required of a handle. In the case of the clear handle, the material should be clear enough that writing on the carton is not obscured.

In order to ensure that the handle not obscure writing on the carton, it is preferred that the light transmission, as measured for a 1.00 mm thick handle, range from 50% to 100%, preferably 60% to 99%, more preferably 75% to 99%, and especially from 85% to 95%. Typical light transmission values for the materials mentioned above for a 1.00 mm thick handle are 84% for polyvinyl chloride, 91% for ethylene vinyl acetate and 99% for Shell's Kraton.

In an advantageous embodiment, the handle of the invention is made of a material which magnifies the printing on the carton. This can be achieved by selecting a curved surface for the outer face of the handle. The flat inner face helps keep the handle snugger to the carton. The handle may also be made with high clarity pigmented material. A pigmented handle may be used to alter the appearance of that portion of the front panel which is viewed through the handle.

As indicated above, the carton of the invention may be provided with tear tape 50, illustrated in FIGS. 1 and 2, for easy opening. Pulling on the tear tape separates the portions of the carton above the tear tape from those below the tear tape, thereby opening the carton, as can be seen in, e.g., FIG. 6. If desired, a small plastic filament or other cord may be adhered to the inside of the tear tape intermediate the cut scores or perforated lines to enhance tearability. The filament may be impregnated with hot melt for hot sealing. The tear tape preferably extends functionally across substantial portions of only three panels of the carton, side panel 16, front panel 12 and side panel 18. Since the tear tape does not extend across substantial portions of rear panel 14, the upper portions of the erected carton, which serve as a cover, remain associated with the lower portions at the rear panel, which serves as a hinge. Thus, once the tear tape is pulled thereby separating upper and lower aspects of the carton on three sides, the upper aspects can be left in the closed position or can be lifted into the open position remaining associated with the lower aspects only at the rear panel. In that open position, the consumer has access to the product and may lower the upper aspects of the carton back into closed position when desired.

In accordance with the invention, the role of the rear panel as a hinge is facilitated by the addition of hinge means thereto. As seen in FIG. 1, rear panel 14 includes two hinge means, perforations 140 and score line 142, both of which extend along the same line as the uppermost of the tear tape cut score or perforations 43. The illustrated hinge means acts as a deadfold hinge in that it keeps the open cover in the open position until the consumer closes the cover.

As seen in FIG. 1, score lien 142 is spaced from both the top and bottom closure flaps and is in the same plane as the tear tape.

As mentioned above, the carton may be provided with liners of various configurations. Three sided liner 56 can be best seen in FIG. 6. Liner 56 comprises a first side panel 108, a front panel 110 separated from side panel 108 by score line 109, and a second side panel 112 separated from panel 110 by score line 111. The liner serves to reinforce the structure of the carton and enhance its barrier properties. It can be seen in FIG. 6 that liner 56 provides a wall upon which cover 114 of the carton can rest when it is in the closed position. Liner 56 minimizes the exposure of the contents which would otherwise result from the gap between the bottom edge 360 of the cover and the top edge 362 of the panels which result from the removal of the tear tape. The dimensions of the panels of the liner are preferably only slightly smaller than those of the corresponding panels of the carton (prior to opening the carton), so that the liner can fit snugly within the carton with the liner panels adjacent the corresponding carton panels. In order to close the container more effectively in one embodiment, the liner may be somewhat larger than the height of the carton and be scored on its top edge so that when the cover is closed the liner folds for more intimate contact with the cover. This is particularly beneficial for liners having barrier properties.

The liners according to the invention are preferably clay coated and the top portion is printed, at least on the side facing the consumer when the carton is open, so as not to detract from the appearance of the package. The printing may, for instance, match that of the outside of the carton.

The liners for the cartons of the invention may be fabricated of paperboard. Alternatively, the liners may be made of a plastic material such as polypropylene. Plastic liners may be thermoformed.

Figure 7:
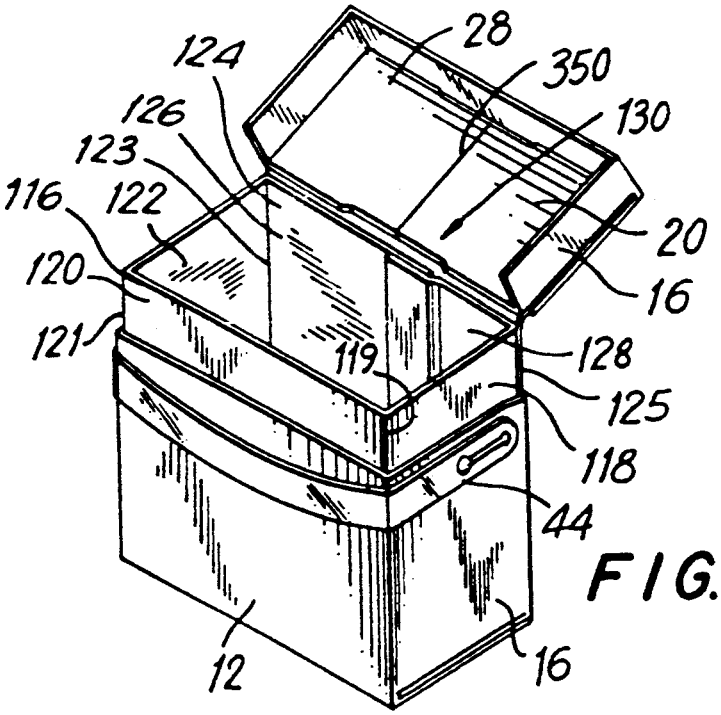
FIG. 7 is a perspective view of an open carton having a four-sided liner.

Particularly preferred are four-sided liners having sides adjacent each of the sides of the carton, as seen in FIG. 7. Four sided liner 116 includes a first side panel 118, a front panel 120 separated from panel 118 by score line 119, a second side panel 122 separated from panel 120 by score line 121, and a rear wall 124 separated from panel 122 by score line 123 and from side panel 118 by score line 125. Rear wall 124 is preferably formed by the overlap of panels 126 and 128 as at 130 in FIG. 7. With this arrangement, the extra thickness at overlap 130 helps balance the carton when it is in the flat, tubular form shown in FIG. 2. Absent balancing means, when partially erected cartons in that form are stacked, the rivets and the handle tend to create a localized increase in thickness which results in an imbalance which will cause the stack to topple over. Advantageously, the overlap where the liner is adhered to itself to create a closed rectangle is situated so as to relieve the imbalance created by the rivets and the handle. It is preferred that the overlap be situated in the middle third of the rear wall, particularly to the right of the midline of the rear wall, as illustrated in FIG. 7. It is especially preferred that the overlap be located between 50 and 85% of the length of the rear panel, especially between 60 and 75% of its length.

As indicated above, the carton blank may be made of a barrier material or provided with a barrier layer. As an additional or alternate feature, the liner may be constituted of or provided with a barrier material. Thus, the liner may be provided with an outside or inside film lamination of a film such as two-sided acrylic-coated oriented polypropylene (Mobil's 420 HS) or polyethylene. FIG. 17 illustrates a paperboard carton blank 226 to which a liner 228 has been riveted (rivets not shown). Liner 228 has a barrier layer 230 adhered thereto. Alternatively, the liner may be comprised of "Super MVTR Board" or another board having barrier properties. The barrier may also be a polyethylene or other extrusion coating or a printed coating. It will be appreciated that either the carton blank or the liner or both may be comprised of or have adhered thereto a barrier material.

An additional solution to the balancing problem discussed above is illustrated in FIGS. 8 through 10, which illustrate a balancing means integral with the carton blank. In FIG. 8, portion 160 of score line 159 is thickened relative to the rest of the line, namely, portions 162 and 164. If the fold line is a 3-point rule score, then the thickened portion could be a 6-point rule score. The extra thick score tends to balance, at least partially, the rivets and the handle when the flattened, tubular cartons are stacked, whereas the regular score lines above and below the thickened score line contribute to sharper folding of the carton. Side 157 is thickened by virtue of the glue flap. When the tube is formed by folding along the two scores other than score 159, then it will generally be desirable to thicken both scores.

Figure 13:
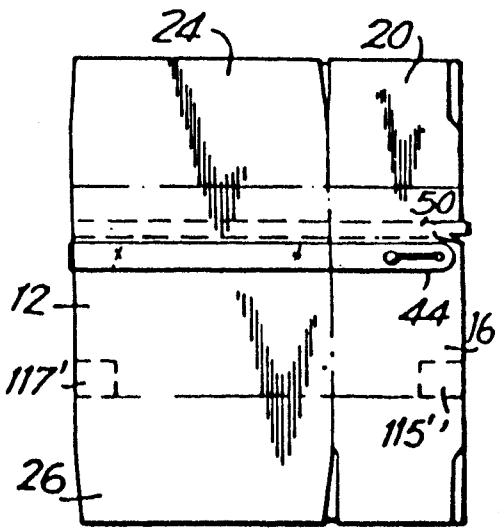
FIG. 13 is top plan view of a flat tubular carton having winged spacers.
Figure 11:
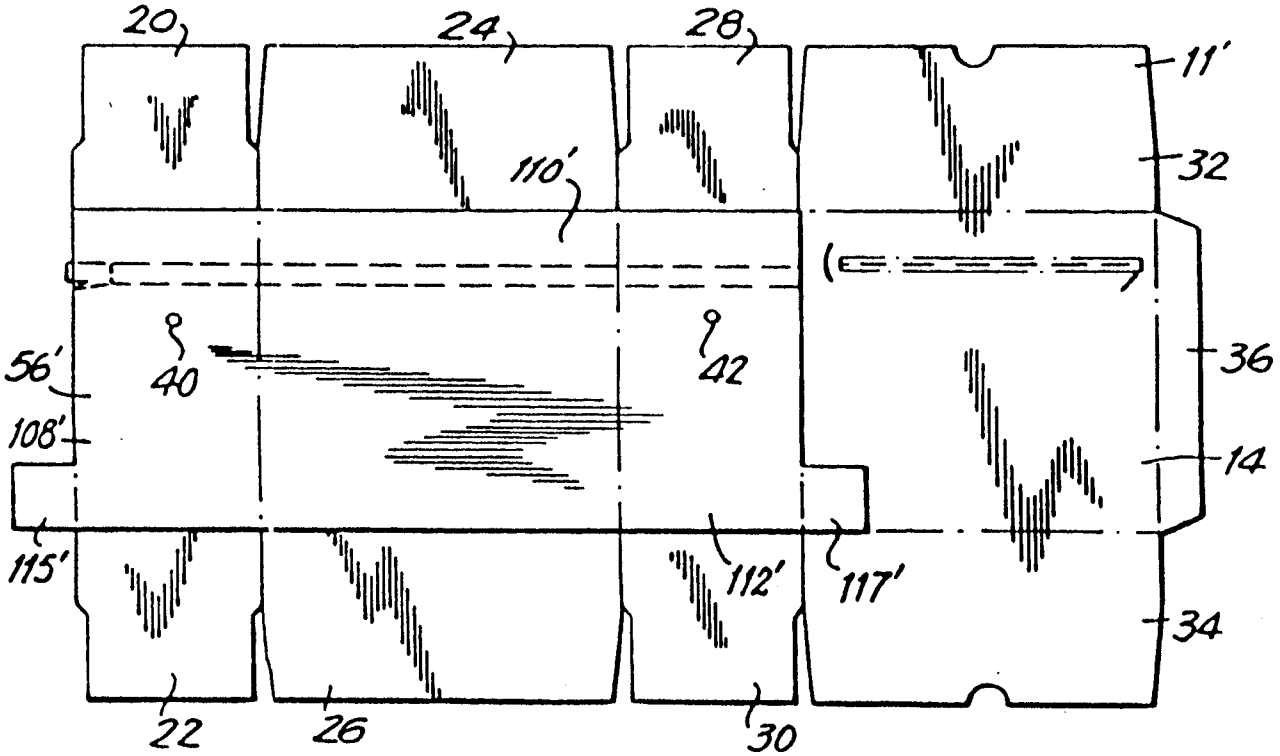
FIG. 11 is a plan view of the inside of a carton blank having a three-sided, winged liner riveted thereto.
Figure 12:
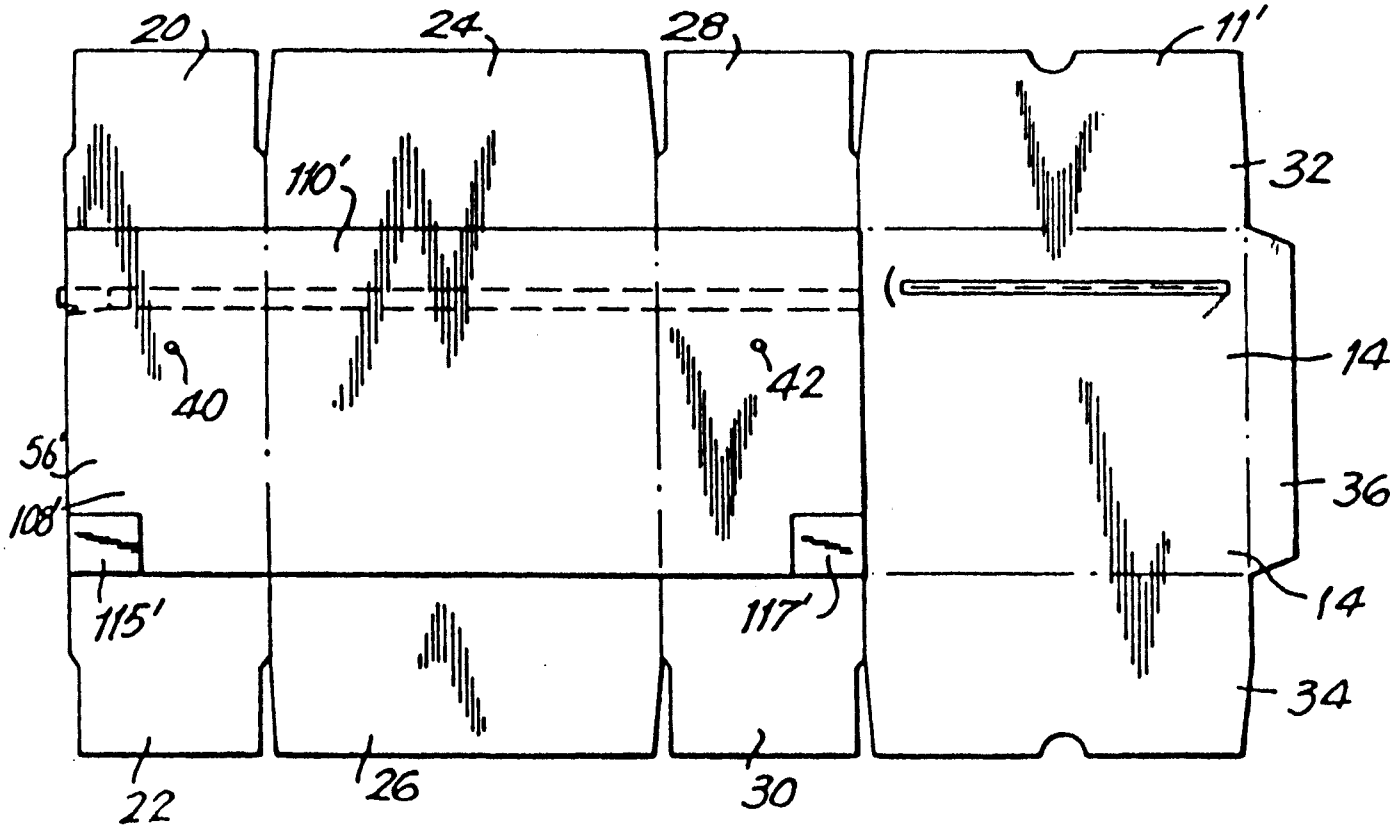
FIG. 12 is a plan view similar to FIG. 11, except that the spacing wings are folded into spacing position.

Integral balancing means may be used on the liner as well as the carton blank. FIGS. 11–13 illustrate one type of balancing means integral with the liner. In FIG. 13, a three-sided liner 56' overlies and is riveted to the inside of carton blank 11'. The liner comprises side panel 108' adjacent front panel 110', which in turn is adjacent side panel 112'. Integral wings 115' and 117' extend from side panels 108' and 112' respectively. In operation, the wings are folded back over the respective side panels from which they depend, as seen in FIG. 12. Once the carton has been partially erected by adhering glue flap 36 to side panel 16 and folded into a flattened tube as seen in FIG. 13, the folded back winged spacers 115' and 117' assist in balancing the thickness of the rivets and the handle, so that the partially erected cartons can be stacked with minimal imbalance.

A further alternate form of integral spacer is an embossment of either the liner or the carton itself or both. As seen in FIG. 14, liner 210 and carton board 211 include embossments 212 and 213 which results in an effective thickening of the liner at that location. The embossment or embossments are situated in the liner and/or the carton blank in such a location that it partially or fully balances the thickness in the partially erected carton attributable to the rivets and the handle. In this way, uneven stacking of the cartons is prevented or minimized. Suitable locations for the embossments include those illustrated for the folded wings in FIG. 13.

The stackability of partially erected cartons may also be addressed by the use of debossments in the liner or the carton blank or both, particularly the carton blank. FIG. 15 illustrates a carton blank 216 upon which a debossment 218 has been imposed and a liner 219 upon which debossment 221 has been imposed. The debossment may be situated below the rivets and handle and would hereby balance their extra thicknesses. Liners fabricated from plastic materials such as polypropylene are particularly suitable where debossments are to be used since debossments can be formed more deeply onto plastic materials than paperboard.

The extra thickness provided by the previously discussed balancing solution may desirably be within the range of 0.08 to 0.25, preferably 0.1 to 0.25 inch thickness.

It may be desired to omit the handle in certain cartons, particularly cartons of a small size. Such a carton 415 is illustrated in FIG. 18. The carton is identical to cartons heretofore illustrated and described except that it lacks the handle and rivets. The use of a handle- and rivet-free carton can be advantageous, particularly in that there is no need for the balancing means described above. However, the handle-free carton does benefit from the other features of the invention including the three and four-sided liners, the long dust flaps, the inside- or outside- film lamination of the carton board or use of barrier carton board, the alternate and/or additional use of barrier-laminated liners or barrier materials for liners and/or the hinge comprising perforated and/or scored lines as hereinbefore described with the carton including handles and rivets.

The carton of the invention is advantageously used to contain powdered detergent, preferably concentrated or superconcentrated detergents. Preferred densities for such detergents include 500 to 700 grams per liter for concentrated and, especially 700 to 1000 grams/liter for superconcentrated. Preferably a scoop is enclosed within the detergent carton to assist the consumer in dispensing the product.

Figure 19:
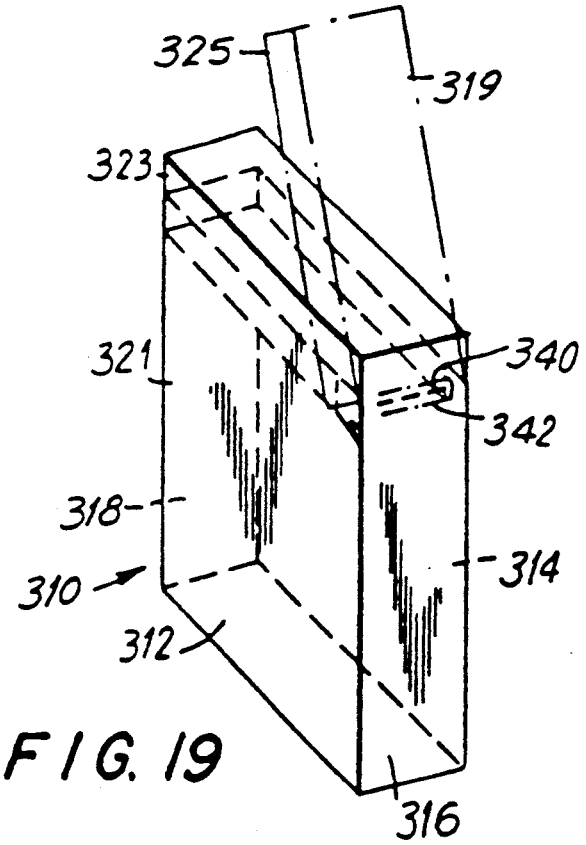
FIG. 19 is a perspective view of an alternate embodiment of the invention.

FIG. 19 illustrates an alternate embodiment of the invention. Carton 310 is constructed similarly to the cartons previously described except that the hinge is on one of the narrow panels instead of one of the broader panels. Carton 310 comprises first side panel 316, front panel 312, second side panel 318 and rear panel 314. The carton is formed by adhering a glue flap (not shown) appended to rear panel 314 to first side panel 316 and then folding inwardly and adhering together the various upper and lower major and minor flaps to produce a fully erected carton.

Carton 310 is provided with a tear tape like the one shown above for separating the cover 319 from the body 321 of the carton. The tear tape comprises a pair of perforated or cut scored, generally parallel lines in the carton board which extend at least from front panel 312 through first side panel 318 to rear panel 314. Portions of the tear tape may be present on first side panel 316, as well, although most of panel 316 is left intact to permit it to serve as a hinge. A narrow cord or plastic filament can be adhered to the tear tape intermediate the parallel cut scores or perforations to facilitate separation of the tear tape, but the tear tape filament is cut to leave most of the first side panel intact. Carton 310 includes a four-sided, full height liner. Each of the four panels of the liner is just slightly smaller than the corresponding panel of the carton so that the liner can be accommodated within the closed carton. First side panel 316 includes perforations 340 and score line 342 in the same plane as bottom edge 325 of the cover to enable first side panel 316 to function as a hinge.

As in the case of previous embodiments, the liner for carton 310 may be three or four-sided and serves to enhance the closability of the carton and improve barrier features. The carton and/or the liner may be inside- or outside-film laminated to provide barrier properties; or, a barrier material such as "Super MVTR Board" may be used as the carton blank and/or the liner. The embodiment of FIG. 19 may be used in various dimensions, such as those used for standard powdered detergent cartons.

As mentioned earlier, the embodiment of FIG. 19 permits the consumer to dispense product from the carton more or less in the manner of a standard detergent carton by grasping a narrow edge of the carton and pouring. Yet, the carton does not include the difficult-to-use perforated opening which is often present. Nor does it employ the environmentally less desirable plastic fitments which have recently appeared in the market.

It should be understood, of course, the the specific forms of the invention herein illustrated and described are intended to be representative only as certain changes may be made therein without departing from the clear teachings of the disclosure. Accordingly, reference should be made to the following appended claims in determining the full scope of the invention.

What is claimed is:

1. A carton comprising a) a first side panel, b) a front panel adjacent thereto, c) a second side panel adjacent to said front panel and opposite said first side panel, d) a rear panel between said first and second side panels, e) bottom closure flaps, f) top closure flaps, g) a tear tape within at least three of said panels suitable for separating portions of at least said first and second side panel and said front panel from each other and extending at least from said first side panel through said front panel to said second side panel h) a liner including i) a first side wall having dimensions prior to opening the tear tape substantially the same as said first side panel, ii) a front wall having dimensions prior to opening the tear tape substantially the same as said front panel, iii) a second side wall adjacent said front wall and opposite said first side wall and having dimensions prior to opening the tear tape substantially the same as said second side panel, and iv) a rear wall having dimensions prior to opening the tear tape substantially the same as said rear panel, said tear tape not traversing the entire rear panel whereby said rear panel acts as a hinge when said tear tape is removed from said first and second side panels and said front panel and a flexible handle extending from said first side panel to said second side panel, said handle having two ends and being attached at said ends by rivets which extend through said side panels and said liner.

2. The carton of claim 1 wherein said liner comprises a leading edge and a trailing edge and wherein said rear wall of said liner comprises a glue flap wherein said leading and trailing edges of said liner overlap.

3. The carton of claim 2 wherein said rear wall comprises three equal longitudinally extending areas comprising a middle and two side areas, said overlap occurring within the middle longitudinally extending area of said rear wall.

4. The carton of claim 3 wherein said rear wall intersects said first and second side walls at a first and second intersecting corner, respectively and said rear wall comprises a midline parallel to and equidistant from said first and second intersecting corners, said overlap occurring substantially at the midline of said rear wall.

5. The carton of claim 1 wherein said tear tape has an upper edge and a lower edge and said liner extends above a line defined by the lower edge of said tear tape.

6. The carton of claim 1 wherein said liner is adhesively attached to at least one of said panels.

7. The carton of claim 1 containing a powder having a density of from 500 to 1000 grams/liter.

8. The carton of claim 7 wherein said powder is detergent powder.

9. The carton of claim 1 further comprising hinge means including a perforated line on said rear panel.

10. The carton of claim 1 wherein said tear tape has an upper edge and a lower edge and wherein said carton further comprises hinge means including a score line on said rear panel extending along the same line as the upper edge of the tear tape, the score line being spaced from the top and bottom closure flaps.

11. The carton of claim 1 wherein said top closure flaps include a major flap having sufficient area to close a top end of the carton and at lest one minor flap depending from each side panel wherein the combined area of said minor flap is at least 75% of the area of said major flap.

12. The carton of claim 1 wherein said liner is integrally formed as a part of a carton blank from which said carton is fabricated.

13. The carton of claim 1 further comprising hinge means including a perforated line within a score line on said rear panel.

14. The carton according to claim 9 wherein said hinge means includes the perforated line within a score line on said rear panel.

15. A carton comprising a) a first side panel, b) a front panel adjacent thereto, c) a second side panel adjacent to said front panel and opposite said first side panel, d) a rear panel between said first and second side panels, e) bottom closure flaps, f) top closure flaps, g) a tear tape extending at least form said first side panel thorugh said front panel to said second side panel, said tear tape not completely functionally traversing the rear panel, whereby said rear panel acts as a hinge when said tear tape is removed from said first and second side panels and said front panel, said hinge on said rear panel further comprising a perforated line within a score line.

16. The carton of claim 15 wherein said first and second side panels include an inside and an outside and further comprising a liner having a) a first side portion abutting the inside of said first side panel, b) a second side portion abutting the inside of said second side panel and c) a connecting portion connecting said first and second side portions and abutting one of said front or back panels.

17. The carton of claim 16 wherein said tear tape has an upper edge and a lower edge and said liner extends above a line defined by the lower edge of said tear tape.

18. The carton of claim 16 wherein the liner has substantially the same dimensions as a carton wall defined by the first side panel, the second side panel, and one of the panels connecting said side panels.

19. The carton of claim 16 further comprising a flexible handle having first and second ends and extending from said first side panel to said second side panel.

20. The carton of claim 19 wherein said handle is attached at one of its ends to one of said side panels and at the second of its ends to the second of said side panels and wherein said ends of said handle are attached to said side panels by rivets which extend through said side panels.

21. The carton of claim 16 wherein said liner is adhesively attached to at least one of said panels.

22. The carton of claim 16 wherein said connecting portion comprises a front wall contacting said front panel, said liner further comprising a rear wall between said two side walls opposite said front wall and contacting said rear panel.

23. The carton of claim 22 wherein the dimensions prior to of the tear tape of said first side wall are substantially the same as those of said first side panel, the dimensions prior to removal of the tear tape of said front wall are substantially the same as those of said front panel, the dimensions prior to removal of the tear tape of said second side wall are substantially the same as those of said second side panel, and the dimensions prior to removal of the tear tape of said rear wall are substantially the same as those of said rear panel.

24. A carton comprising a) a first side panel, b) a front panel adjacent thereto, c) a second side panel adjacent to said front panel and opposite said first side panel, d) a rear panel between said first and second side panels, e) bottom closure flaps, f) top closure flaps, g) a tear tape having an upper edge and a lower edge suitable for separating portions of the panels from each other and extending at least from said first side panel through said front panel to said second side panel, said tear tape not functionally traversing the entire rear panel, whereby said rear panel acts as a hinge when said tear tape is removed from said first and second side panels and said front panel, and h) hinge means including a perforated line within a score line on said rear panel extending along the same line as the upper edge of the tear tape, the score line being spaced from the top and bottom closure flaps.

25. The carton of claim 24 wherein all of said panels are barrier panels.

26. The carton of claim 25 wherein each of said barrier panels is an inside film laminated panel.

27. The carton of claim 24 further comprising a liner having a first side wall, b) a front wall having a first side adjacent said first side wall and a second side opposite said first side, c) a second side wall adjacent said front wall on said second side thereof, and d) a rear wall, said liner not having a water vapor transmission rate of greater than 0.5 grams of water per 100 square inches per 24 hours at 80° F./80% R.H.

28. The carton of claim 24 further comprising a flexible handle extending from the first side panel to the second side panel.

29. The carton of claim 24 wherein said top closure flaps include a major flap having sufficient area to close a top end of the carton and at least one minor flap depending from each side panel wherein the combined area of said minor flap is at least 75% of the area of the major flap.

30. The carton of claim 24 wherein said hinge means includes a perforated line within the score line on said rear panel.

31. A carton comprising a) a first side panel, b) a front panel adjacent thereto, c) a second side panel adjacent to said front panel and opposite said first side panel, d) a rear panel between said first and second side panels, e) bottom closure flaps, f) top closure flaps, g) a tear tape extending at least from said first side panel through said front panel to said second side panel, a flexible handle having two ends extending from the first side panel to the second side panel, said handle including an aperture including a straight narrow portion and one rounded, semicircular portion at each of said ends, one of said rounded portions being disposed above said narrow portion and the other of said rounded portions being disposed below said narrow portion.

32. The carton of claim 31 wherein said handle is attached to said side panels with rivets.

33. The carton of claim 31 further comprising hinge means including a perforated line within a score line on said rear panel.

34. The carton of claim 31 further comprising a liner having a first side portion having dimension substantially the same as said first side panel, b) a front portion having dimensions substantially the same as said front panel, c) a second side portion adjacent said front portion and opposite said first side portion and having dimensions substantially the same as said second side panel, and d) a rear portion having dimensions substantially the same as said rear panel.

35. A flexible handle having two ends having an aperture including a straight, narrow portion and one rounded semicircular portion at each of said ends, one of said rounded portions being disposed above said narrow portion and the other of said rounded portions being disposed below said narrow portion.

36. A carton comprising a first side panel, a front panel adjacent thereto, a second side panel adjacent to said front panel and opposite said first side panel, a rear panel between said first and second side panels, said first and second side panels each having an inside and an outside, bottom closure flaps, top closure flaps, a tear tape extending at least form said first side panel through said front panel to said second side panel, said tear tape not functionally traversing the entire rear panel, whereby said rear panel acts as a hinge when said tear tape is removed from said first and second side panels and said front panel, and further comprising a liner having a first side portion abutting the inside of said first side panel, a second side portion abutting the inside of said second side panel and a connecting portion connecting said first and second side portions and abutting one of said front or back panels, said liner having substantially the same dimensions as a carton wall defined by the first side panel, the second side panel, and one of the panels connecting said first and second side panels.

* * * * *

UNITED STATES PATENT AND TRADEMARK OFFICE

CERTIFICATE OF CORRECTION

PATENT NO. : 5,320,279
DATED : June 14, 1994
INVENTOR(S) : Edward J. Giblin, et al.

It is certified that error appears in the above-identified patent and that said Letters Patent is hereby corrected as shown below:

Column 14, claim 36, line 21, after "panel," insert --and a flexible handle extending from said first side panel to said second side panel,--.

Signed and Sealed this

Twenty-third Day of March, 1999

*Attest:*

*Attesting Officer*

Q. TODD DICKINSON

*Acting Commissioner of Patents and Trademarks*